US005906803A

United States Patent [19]

Leppalahti

[11] Patent Number: 5,906,803

[45] Date of Patent: May 25, 1999

[54] PROCESS FOR REMOVING AMMONIA FROM GASIFICATION GAS

[75] Inventor: Jukka Leppalahti, Espoo, Finland

[73] Assignee: Valton Teknillinen Tutkismuskeskus, Espoo, Finland

[21] Appl. No.: 08/809,862

[22] PCT Filed: Oct. 4, 1995

[86] PCT No.: PCT/FI95/00543

§ 371 Date: Jun. 20, 1997

§ 102(e) Date: Jun. 20, 1997

[87] PCT Pub. No.: WO96/11243

PCT Pub. Date: Apr. 18, 1996

[30] Foreign Application Priority Data

Oct. 5, 1994 [FI] Finland ..... 944642

[51] Int. Cl.[6] ..... C01B 1/12

[52] U.S. Cl. ..... 423/237; 423/235; 423/239.1; 423/351

[58] Field of Search ..... 423/235, 239.1, 423/237, 351

[56] References Cited

U.S. PATENT DOCUMENTS

| | | | |
|---|---|---|---|
| 3,467,491 | 9/1969 | Hardison . | |
| 3,914,390 | 10/1975 | Kudo et al. | 423/239.1 |
| 4,080,426 | 3/1978 | Kittrell et al. | 423/351 |
| 4,093,707 | 6/1978 | Merkl | 423/239.1 |
| 4,096,096 | 6/1978 | Nishkawa et al. | 423/239.1 |
| 4,179,407 | 12/1979 | Iiyama et al. | 423/351 |
| 4,220,632 | 9/1980 | Pence et al. | 423/239 |
| 4,258,020 | 3/1981 | Ginger | 423/239.1 |
| 4,368,057 | 1/1983 | Matthews | 423/351 |
| 4,609,539 | 9/1986 | Horecky et al. | 423/239.1 |
| 4,692,318 | 9/1987 | Tozpin et al. | 423/239.1 |
| 4,778,665 | 10/1988 | Kishnamurthy et al. | 423/235 |

FOREIGN PATENT DOCUMENTS

| | | |
|---|---|---|
| 421468 | 4/1991 | European Pat. Off. . |
| 437608 | 4/1991 | European Pat. Off. . |
| 85823 | 8/1988 | Finland . |
| 83393 | 5/1990 | Finland . |
| 3020975 | 12/1981 | Germany . |

*Primary Examiner*—Gary P. Straub
*Attorney, Agent, or Firm*—Loeb & Loeb LLP

[57] ABSTRACT

The invention relates to a process for the removal of ammonia from gasification gas by selective oxidation in the presence of a solid catalyst. The oxidant used may be a mixture of oxygen and one or more oxides of nitrogen, e.g. nitrogen monoxide NO, whereupon gaseous nitrogen, water and possibly hydrogen are obtained as the result of the oxidation reaction. According to the invention, the catalyst used is aluminum oxide, which catalyzes the reaction within a temperature range of approx. 400° C. 700° C. The catalyst, made up of small particles, may be in the form of a solid or fluidized bed (12) in a separate oxidation reactor (11) subsequent to the gasifier (1).

14 Claims, 1 Drawing Sheet

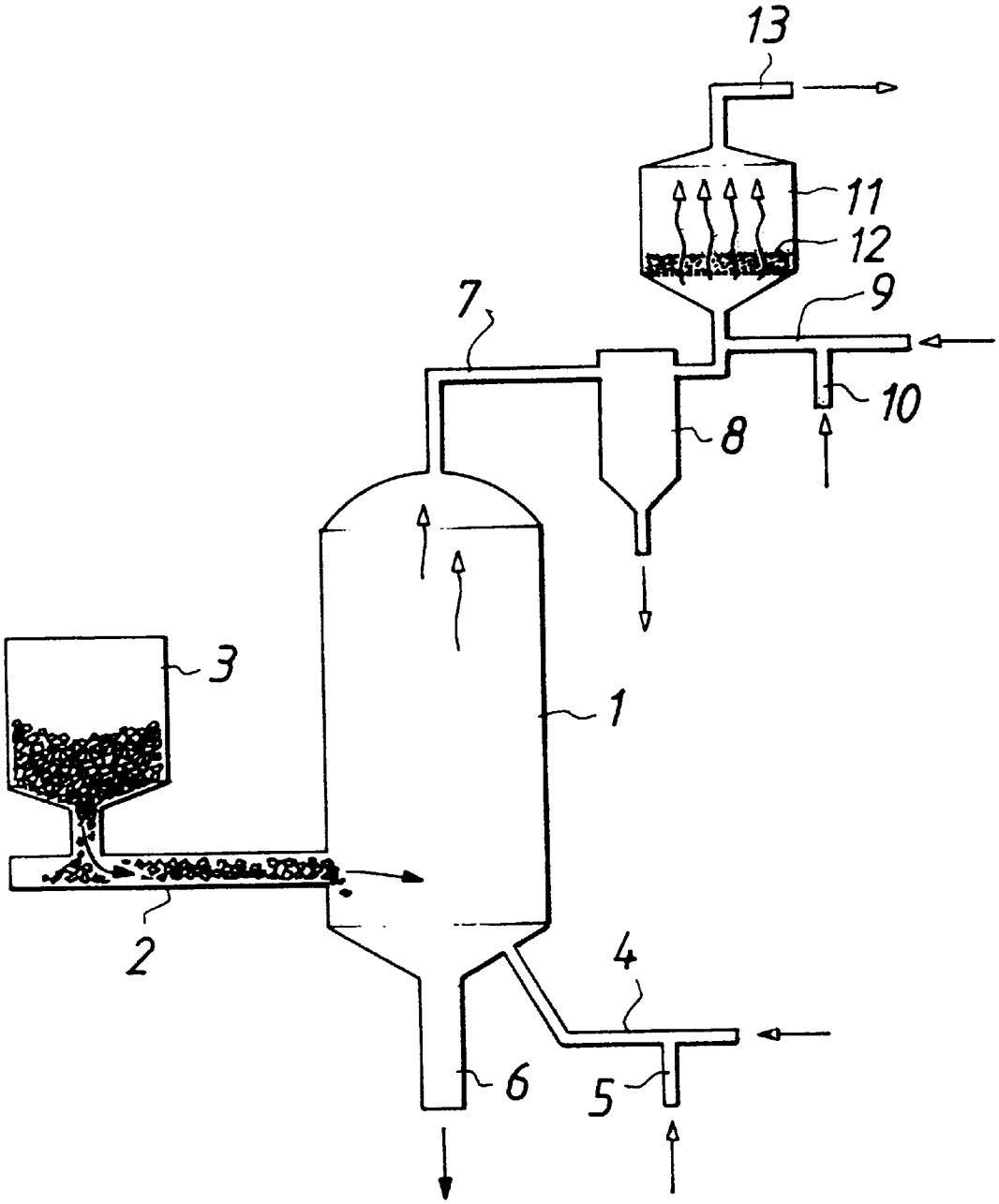
13
11
12
9
7
10
8
3
1
2
4
6
5

PROCESS FOR REMOVING AMMONIA FROM GASIFICATION GAS

The present invention relates to a process for removing, by selective oxidation in the presence of a solid catalyst, ammonia from gasification gas obtained from fuel.

In the gasification of a fuel, such as carbon, peat or fuel oil, the fuel and an oxygen-containing gas, such as air or oxygen, form a gasification gas the principal components of which are, depending on the conditions, carbon monoxide, carbon dioxide, hydrogen, methane, water, and nitrogen. In addition, the gasification gas contains ammonia formed from the nitrogen present in the fuel. In the subsequent combustion step the ammonia of the gasification gas burns to oxides of nitrogen, such as nitrogen monoxide NO or nitrogen dioxide $NO_2$. To avoid environmental problems, the emission of these acidifying gases into the atmosphere is to be prevented, and this can be done by the use of a specific combustion technique by which the burning of ammonia to nitrogen oxides is prevented, or by removing ammonia from the gasification gas before the combustion step The present invention concerns the latter solution model.

It is a previously known method to remove ammonia from gasification gas by scrubbing the gas before the combustion step. This method has the disadvantage that the scrubbing will cool the gas radically, thereby reducing the efficiency ratio of the process. According to another known method, the ammonia is removed by selective oxidation of the gasification gas. FI lay-open print 83393 describes a technique in which oxygen and nitrogen oxides, in particular nitrogen monoxide NO, are fed into the midst of the gasification gas in order to cause a reaction in which gaseous nitrogen and water are formed. According to the publication, the reaction can be accelerated by means of a selective catalyst, such as dolomite or zeolite. FI lay-open print 89810 describes a catalyst suitable, for example, for the said ammonia removal reaction, the catalyst being made up mainly of an oxide of iron or nickel, mixed with a carbonate or oxide of an alkali metal or an earth alkali metal By using such a catalyst, 75–90% of the ammonia present in gasification gas has been decomposed at a reaction temperature of 900° C.

The object of the present invention is to make more effective the oxidation of the ammonia present in gasification gas by using a new catalyst, which oxidizes ammonia selectively, i.e. without substantially affecting hydrogen, methane or other oxidizing components of the gasification gas, and by means of which the ammonia can be decomposed more completely and/or at a substantially lower temperature than by means of previously used catalysts. The invention is characterized in that the catalyst used is made up of aluminum oxide $Al_2O_3$.

According to preliminary experiments, when the catalyst consists of a substantially pure aluminum oxide $Al_2O_3$, 90–98% of the ammonia present in gasification gas can be caused to react to form nitrogen at a reaction temperature of 400–600° C. The oxidant used was a mixture of oxygen and nitrogen monoxide NO.

On the basis of the experiments it seems-that the most advantageous application of the invention is the oxidation of ammonia by means of oxygen and nitrogen monoxide by using aluminum oxide as a catalyst, at a reaction temperature of approx. 400–500° C. Thereby a maximal conversion of ammonia to nitrogen is achieved within a temperature range which corresponds to the temperature to which the temperature of the gasification gas in many combustion plants is even otherwise adjusted between the gasification and the combustion.

The contact between the reacting gas mixture and the catalyst can be achieved advantageously in a solid or fluidized bed made up of small catalyst particles, most preferably less than 1 mm in size. Such a catalyst bed may be located in a separate oxidation reactor which is equipped with heat controls and in which the reacting gas mixture is caused to flow through the bed, the oxidation reactor being located at a point subsequent to the gasification reactor The reaction time in the solid or fluidized catalyst bed may be approx. 1–2 s.

In addition to the process, the invention relates to the use of aluminum oxide as a catalyst in selective oxidation, by means of oxygen and one or more oxides of nitrogen, of the ammonia present in gasification gas.

The invention is illustrated below in greater detail by means of examples by describing first the apparatus according to the accompanying drawing, intended for the implementation of the invention, and thereafter the oxidation experiments performed (Examples 1–2).

The apparatus according to the drawing comprises a fluidized-bed gasifier 1, into which fuel such as particle-form carbon or peat is fed via a pipe 2 from a container 3. In addition to the fuel, also lime can be fed into the gasifier 1 according to need. The oxygen-containing gas, such as air, required by gasification is fed into the gasifier through pipe 4. An oxide of nitrogen, such as nitrogen monoxide NO, can be added via branch pipe 5 to this feed gas.

Pyrolysis of the fuel fed in takes place in the fluidized-bed gasifier 1, and as a result a gas mixture is formed the principal components of which are CO, $CO_2$, $H_2$, $CH_4$, $H_2O$, and $N_2$. The precise composition of the mixture varies according to the fuel used and the gasification conditions. In addition to the said principal components the mixture contains ammonia, which is formed in the pyrolysis from the nitrogen compounds present in the fuel, and various impurities in low concentrations.

The ashes left from the fuel in the pyrolysis are removed from the gasifier 1 into an outlet pipe 6. The gasification gas containing the above-mentioned gas components is directed from the gasifier 1 to pipe 7, which is equipped with a cyclone 8 for removing dust from the gas.

After the cyclone 8, a gaseous oxidant is added to the gasification gas, the oxidant being made up of oxygen fed in through pipe 9 and a nitrogen oxide, such as nitrogen monoxide, fed in through branch pipe 10. The purpose of the oxidant is to cause, in the catalyst bed 12 in the subsequent oxidation reactor 11, a selective oxidation of the ammonia present in the gasification gas. The catalyst bed 12, which may be solid or fluidized by a gas flow traveling through it, is made up of aluminum oxide particles having a diameter of approx. 1 mm or even less, which particles at the temperature of approx. 400–700° C. prevailing in the reactor 11 catalyze the reaction of ammonia, nitrogen oxide and oxygen to gaseous nitrogen, water and possibly hydrogen. The reactor 11 is equipped with means (not shown) for adjusting the reaction temperature. The average retention time of the gasification gas in the catalyst bed 12 is set at approx. 1–2 s. The selectively oxidized gas mixture passing from the reactor 11 into pipe 13 can be directed, for example, as fuel into the gas turbine of a combined gasification power plant.

EXAMPLE

Aluminum oxide particles which were 100% $Al_2O_3$ and the size of which was less than 1 mm were placed as a solid bed on a grate in a tubular reactor. The reactor was located in a furnace the temperature of which was adjustable. A gasification gas mixture which contained, calculated according to the volume, 13% CO, 13% $CO_2$, 12% $H_2$, 1% $CH_4$, 10% $H_2O$, 52.5% $N_2$ and 0.5% (4900 ppm) $HN_3$ was directed at different temperatures through the bed. At a point immediately before the aluminum oxide bed, 2% $O_2$ and 5000 ppm NO were added to the gasification gas. The amount of catalyst in proportion to the gas flow was such that the retention time of the gas in the bed was 1.2–1.9 s. The ammonia amounts measured from the gasification gas after oxidation at different temperatures are shown in the following Table.

| Temperature | $NH_3$ |
|---|---|
| 400° C. | 80 ppm |
| 600° C. | 400 ppm |
| 800° C. | 2800 ppm |

It can be seen that ammonia can best be removed from the gasification gas at temperatures below 600° C.

For an expert in the art it is clear that the various embodiments of the invention are not limited to those shown above by way of example but may vary within the accompanying claims. It is, for example, possible to arrange the contact between the gasification gas and the catalyst in some manner other than in a separate bed of catalyst particles through which the gas flows. In the gas mixture constituting the oxidant, nitrogen monoxide may in part or entirely be replaced with some other oxide of nitrogen in which the degree of oxidation of the nitrogen is at least +1, such as nitrous oxide $N_2O$ or nitrogen dioxide $NO_2$.

I claim:

1. A process for removing ammonia, by selective oxidation in the presence of a solid catalyst from a gasification gas obtained from a fuel, characterized in that the catalyst consists essentially of pure aluminum oxide $Al_2O_3$.

2. A process according to claim 1, characterized in that the oxidant used is a mixture of oxygen and at least one oxide selected from the group consisting of oxides of nitrogen.

3. A process according to claim 2, characterized in that the oxidant used is a mixture of oxygen and nitrogen monoxide NO.

4. A process according to claim 1, characterized in that the oxidation takes place in a fluidized bed containing catalyst particles.

5. A process according to claim 1, characterized in that the gasification gas is directed through at least one of a fluidized bed and a solid bed made up of catalyst particles.

6. A process according to claim 5, characterized in that the reaction time in said at least one of a fluidized bed and a solid bed is approx. 1–2 s.

7. A process according to claim 5, characterized in that the oxidation of ammonia takes place in a separate oxidation reactor (11), located after the gasification reactor (1) and containing a catalyst bed (12).

8. A process according to claim 1, characterized in that the oxidant comprises gaseous oxygen.

9. A process according to claim 1, characterized in that the gasification gas is directed through a solid bed made up of catalyst particles which particles are less than 1 mm in size.

10. A process according to claim 1, characterized in that the reaction temperature is within a range of from about 400 to about 700° C.

11. A process according to claim 1, characterized in that the reaction temperature is within a range of from about 400 to about 500° C.

12. A process according to claim 1, wherein said catalyst is pure aluminum oxide.

13. A process according to claim 1, wherein the gasification gas is a mixture of ammonia and at least one compound selected from the group consisting of carbon monoxide, hydrogen and methane.

14. A process according to claim 1, wherein the gasification gas contains at least carbon monoxide, hydrogen, methane and carbon dioxide in a mixture with ammonia.

* * * * *

UNITED STATES PATENT AND TRADEMARK OFFICE

CERTIFICATE OF CORRECTION

PATENT NO. : 5,906,803

DATED : May 25, 1999

INVENTOR(S) : Jukka Leppalahti

It is certified that error appears in the above-identified patent and that said Letters Patent is hereby corrected as shown below:

On the title page, item [73] Assignee,

"Valton Teknillinen Tutkismuskeskus" is incorrect. It should read -- Valtion Teknillinen Tutkimuskeskus --.

Signed and Sealed this

Ninth Day of November, 1999

*Attest:*

Q. TODD DICKINSON

*Attesting Officer*

*Acting Commissioner of Patents and Trademarks*